US011124903B2

(12) United States Patent
Su et al.

(10) Patent No.: US 11,124,903 B2
(45) Date of Patent: Sep. 21, 2021

(54) PRODUCTION DEVICE AND PRODUCTION METHOD FOR MAGNETIC FIBER BLENDED CONFORMAL YARNS, AND MAGNETIC FIBER BLENDED CONFORMAL YARNS

(71) Applicant: Jiangnan University, Jiangsu (CN)

(72) Inventors: Xuzhong Su, Jiangsu (CN); Xinjin Liu, Jiangsu (CN); Chunping Xie, Jiangsu (CN); Bojun Xu, Jiangsu (CN); Juan Song, Jiangsu (CN); Lifen Chen, Jiangsu (CN); Xiuming Cao, Jiangsu (CN); Qiang Wang, Jiangsu (CN)

(73) Assignee: Jiangnan University, Binhu (CN)

( * ) Notice: Subject to any disclaimer, the term of this patent is extended or adjusted under 35 U.S.C. 154(b) by 122 days.

(21) Appl. No.: 16/478,748

(22) PCT Filed: Jul. 24, 2018

(86) PCT No.: PCT/CN2018/096814

§ 371 (c)(1),
(2) Date: Jul. 17, 2019

(87) PCT Pub. No.: WO2019/178991

PCT Pub. Date: Sep. 26, 2019

(65) Prior Publication Data

US 2021/0102314 A1 Apr. 8, 2021

(30) Foreign Application Priority Data

Mar. 20, 2018 (CN) ..... 201810227512.X

(51) Int. Cl.
*D02G 3/04* (2006.01)

(52) U.S. Cl.
CPC ..... *D02G 3/04* (2013.01); *D10B 2401/00* (2013.01)

(58) Field of Classification Search
None
See application file for complete search history.

(56) References Cited

U.S. PATENT DOCUMENTS 3,149,403 A 9/1964 Aurich et al.

FOREIGN PATENT DOCUMENTS

CN 1861860 * 11/2006
CN 101012588 8/2007
(Continued)

OTHER PUBLICATIONS

Machine translation of CN 1861860 (Year: 2006).*
(Continued)

*Primary Examiner* — Shawn Mckinnon
(74) *Attorney, Agent, or Firm* — Lei Fang; Smith Tempel Blaha LLC

(57) ABSTRACT

Disclosed are a production device and a production method for magnetic fiber blended conformal yarns. Fed roving includes at least two types of fiber blended roving, including magnetic fibers. By adding left and right magnets on the outer circumference of a middle roller, the magnetic fibers in first strands obtained by untwisting and drawing the roving in a rear drawing zone are dispersed within a certain width range; by adding an adsorption roller that rotates synchronously with a front rubber roller to the front part thereof, and adding an adsorption magnet to the outer circumference of a certain width of an adsorption roller, the magnetic fibers in second strands obtained by drawing the first strands in a front drawing zone are adsorbed upward, the fibers except the magnetic fibers in the second strands are strongly twisted close to the lower part of the front roller and located at the cores of final yarns, and the magnetic fibers are weakly twisted close to the upper part of the adsorption roller and
(Continued)

located at the outer parts of the final yarns, thereby forming overall yarn structures that are tight inside but loose outside.

3 Claims, 1 Drawing Sheet

(56) References Cited

FOREIGN PATENT DOCUMENTS

| | | | |
|---|---|---|---|
| CN | 103774316 | * | 5/2014 |
| CN | 103898638 | | 7/2014 |
| CN | 105624853 | | 6/2016 |
| WO | 2010016808 | | 2/2010 |

OTHER PUBLICATIONS

Machine translation of CN 103774316 (Year: 2014).*
International Search Report and Written Opinion dated Nov. 28, 2018 for PCT Patent Application PCT/CN2018/0968914.

* cited by examiner

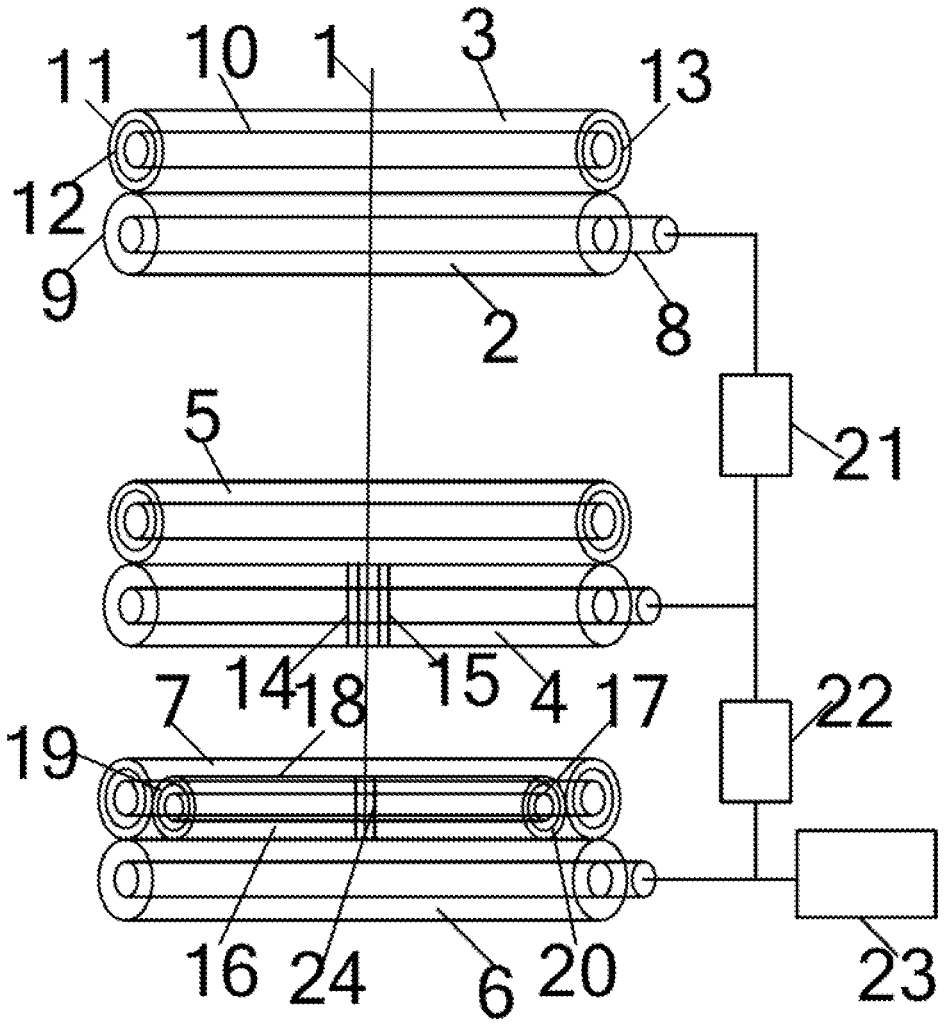
11
10
1
3
13
12
9
2
8
21
5
14
15
4
7
18
17
22
19
16
24
6
20
23

PRODUCTION DEVICE AND PRODUCTION METHOD FOR MAGNETIC FIBER BLENDED CONFORMAL YARNS, AND MAGNETIC FIBER BLENDED CONFORMAL YARNS

CROSS-REFERENCE TO RELATED APPLICATIONS

This application is a 371 U.S. National Phase of PCT International Application No. PCT/CN2018/096814 filed on Jul. 24, 2018, which claims benefit and priority to Chinese patent application No. 201810227512.X filed on Mar. 20, 2018. Both of the above-referenced applications are incorporated by reference herein in their entireties.

FIELD OF THE INVENTION

The present invention relates to the technical field of textiles, in particular to a production device and a production method for magnetic fiber blended conformal yarns, and magnetic fiber blended conformal yarns.

DESCRIPTION OF RELATED ART

With the increasing development of social economy and the continuous improvement of people's living standards, people's consumption concepts are constantly updated, the requirements for the functionality and serviceability of clothing are increasingly high, and particularly, the requirements for the antibacterial property, health care, hand feeling and the like of clothing are constantly improved. On the other hand, with the development of economy, the application fields of various functional fibers and textiles are gradually expanded. Therefore, the research and development of fiber materials with various special functions have been paid more and more attention, and the types of functional fiber materials are increasingly complete. However, the performance of various existing functional fibers is often relatively simple. For example, bamboo carbon fibers have excellent antibacterial property, but poor hand feeling, skin friendliness, cohesive force and spinnability. Therefore, functional textiles with comprehensive performance need blending of a variety of fibers. How to use different varieties and different proportions of fibers for thorough and uniform blending and what type of spinning process can be used to spin functional high-quality yarns with good performance are the problems to be urgently solved at present.

SUMMARY OF THE INVENTION

Technical Problem

The present invention is directed to magnetic fiber blended conformal yarns and a production method thereof to realize that under the action of a twist, other fibers except magnetic fibers in fed blended roving abut against the lower part of a front roller and are strongly twisted and located at cores of final yarns, and the magnetic fibers abut against the upper part of an adsorption roller and are weakly twisted and located at the outer parts of the final yarns, thereby forming overall yarn structures that are tight inside but loose outside, and achieving high conformal property and excellent health-care effect of the blended yarns.

Technical Solution

In order to achieve the above objective, the present invention adopts the following technical solution:

A production device for magnetic fiber blended conformal yarns, including a rear roller drawing pair consisting of a rear lower roller and a rear upper rubber roller, a middle roller drawing pair consisting of a middle lower roller and a middle upper rubber roller, and a front roller drawing pair consisting of a front lower roller and a front upper rubber roller, where the front lower roller is driven to rotate by a motor; the middle lower roller is driven to rotate by the front lower roller through a first gear box; the rear lower roller is driven to rotate by the middle lower roller through a second gear box; and a left magnet and a right magnet are oppositely arranged around the outer circumference of the middle lower roller; an adsorption roller is mounted to the front part of the front upper rubber roller, the adsorption roller abuts against the front upper rubber roller, and a middle magnet is arranged on the outer circumference of the adsorption roller; the left magnet, the right magnet and the middle magnet have the same polarity at relative positions of magnetic fibers, and are opposite in polarity to the magnetic fibers.

Further, the rear lower roller, the middle lower roller and the front lower roller have the same structure, and each includes a solid lower intermediate shaft and a roller sleeve integrally fixedly connected to the lower intermediate shaft; the rear upper rubber roller, the middle upper rubber roller and the front upper rubber roller have the same structure with the adsorption roller, each includes a solid upper intermediate shaft, a rubber roller sleeve is sleeved on the upper intermediate shaft, the rubber roller sleeve can rotate freely about the upper intermediate shaft, and the rear upper rubber roller, the middle upper rubber roller and the front upper rubber roller are clasped and connected to a pressing assembly in an embedded manner.

Further, the rubber roller sleeves of the rear upper rubber roller, the middle upper rubber roller, the front upper rubber roller and the adsorption roller are connected to the intermediate shafts through bearings arranged at the left and right ends.

The rotation speed ratio of the rear lower roller to the middle lower roller is equal to a drawing multiple of a rear drawing zone between the rear roller drawing pair and the middle roller drawing pair, and is determined by a gear ratio of the second gear box; the rotation speed ratio of the middle lower roller to the front lower roller is equal to a drawing multiple of a front drawing zone between the middle roller drawing pair and the front roller drawing pair, and is determined by a gear ratio of the first gear box; and the drawing multiple of the rear drawing zone is far smaller than the drawing multiple of the front drawing zone.

A production method for magnetic fiber blended conformal yarns by using the above production device for magnetic fiber blended conformal yarns, including the following steps:

(1) feeding blended roving by pressing at the rear roller drawing pair, where the fed blended roving includes at least two types of short fibers, including at least one type of magnetic fiber and at least one type of non-magnetic fiber; untwisting and drawing the blended roving at the rear drawing zone between the rear roller drawing pair and the middle roller drawing pair, and thoroughly dispersing the magnetic fibers in first strands obtained between the left magnet and the right magnet; and (2) strongly twisting and thoroughly drawing the first strands at the front drawing zone between the middle roller drawing pair and the front roller drawing pair, and upwardly adsorbing the magnetic fibers in second strands obtained through the middle magnet on the adsorption roller; and causing other fibers except the magnetic fibers in the second strands to form cores of final yarns, and the magnetic fibers in the second strands to form the outer parts of the final yarns, thus forming overall yarn structures that are tight inside but loose outside.

Specifically, in step (1), when spinning, the pressing assembly is pressed down, so that the rear lower roller and the rear upper rubber roller, the middle lower roller and the middle upper rubber roller, and the front lower roller and the front upper rubber roller press each other tightly, the motor directly drives the front lower roller to rotate, the front lower roller drives the middle lower roller to rotate, and the middle lower roller drives the front lower roller to rotate; and the rear lower roller, the middle lower roller and the front lower roller respectively drive the rear upper rubber roller, the middle upper rubber roller, the front upper rubber roller and the adsorption roller to rotate.

The rotation speed of the rear roller drawing pair is smaller than that of the middle roller drawing pair; the fed blended roving is advanced between the rear roller drawing pair and the middle roller drawing pair, so that the linear density of the fed blended roving becomes small in a ratio equal to the drawing multiple of the rear drawing zone, and a weak drawing process and a strong untwisting process of the fed roving are achieved; the fed blended roving form first strands of fibers with a weak twist under the drawing and untwisting action in the rear drawing zone; when being discharged in front of the middle roller drawing pair, the magnetic fibers are further dispersed in the first strands under the attraction of the left magnet and the right magnet, and drive other fibers to move during attracted movement, so that all the fibers in the first strands are further dispersed, the twist of the first strands is further reduced, and the magnetic fibers are mainly distributed on the left and right sides in the first strands. In step (2), the rotation speed of the middle roller drawing pair is smaller than that of the front roller drawing pair; the first strands are advanced between the middle roller drawing pair and the front roller drawing pair, so that the linear density of the first strands becomes small in a ratio equal to the drawing multiple of the front drawing zone, a strong drawing process and a weak untwisting process of the first strands in the front drawing zone are achieved, and second strands with a very weak twist are obtained; the magnetic fibers on the left and right sides of the second strands discharged by the front roller drawing pair float under the attraction of the middle magnet, so that the magnetic fibers are closely attached to the surface of the adsorption roller and discharged forward with the rotation of the adsorption roller, the other fibers are closely attached to the surface of the front roller and discharged forward, and the other fibers except the magnetic fibers in the second strands are strongly twisted close to the front roller and located at the cores of final yarns; the fibers are inconsistent with the direction of twist transmission due to the floating of the magnetic fibers, so that the magnetic fibers are indirectly twisted by the design twist, where the degree of twisting the magnetic fibers is smaller than that of twisting the other fibers; since the magnetic fibers are mainly located on the left and right sides of the other fibers, the magnetic fibers in the second strands are twisted close to the upper part of the adsorption roller and located at the outer parts of the final yarns, and the magnetic fibers are intertwined into short fiber aggregates under the weak twist to completely cover and coat the cores to obtain final magnetic fiber blended conformal yarns.

Magnetic fiber blended conformal yarns produced by the above production method for magnetic fiber blended conformal yarns is characterized in that the magnetic fibers of the magnetic fiber blended conformal yarns are intertwined into short fiber aggregates to completely cover and coat cores, thus forming overall yarn structures that are tight inside but loose outside.

Advantageous Effect

By adding left and right magnets on the outer circumference of a certain width of the middle lower roller, the magnetic fibers in the first strands obtained by untwisting and drawing the fed blended roving containing the magnetic fibers in the rear drawing zone are thoroughly dispersed within a certain width range; by adding an adsorption roller that rotates synchronously with the front upper rubber roller to the front part of the front upper rubber roller, and adding a middle magnet to the outer circumference of a certain width of the adsorption roller, the magnetic fibers in the second strands obtained by thoroughly drawing the first strands in the front drawing zone are adsorbed upward, the other fibers except the magnetic fibers, under the degree of twist, in the second strands are strongly twisted close to the lower part of the front lower roller and located at the cores of final yarns, and the magnetic fibers in the second strands are weakly twisted close to the upper part of the adsorption roller and located at the outer parts of the final yarns, thereby forming overall yarn structures that are tight inside but loose outside, and achieving high conformal property and excellent health-care effect of the blended yarns.

BRIEF DESCRIPTION OF THE DRAWING

FIG. 1 is a structural schematic view of a production device for magnetic fiber blended conformal yarns according to the present invention.

DETAILED DESCRIPTION OF THE INVENTION

A production device for magnetic fiber blended conformal yarns as shown in FIG. 1 includes a rear roller drawing pair consisting of a rear lower roller 2 and a rear upper rubber roller 3, a middle roller drawing pair consisting of a middle lower roller 4 and a middle upper rubber roller 5, and a front roller drawing pair consisting of a front lower roller 6 and a front upper rubber roller 7. The rear lower roller 2, the middle lower roller 4 and the front lower roller 6 have the same structure, and each includes a lower intermediate shaft 8. The lower intermediate shaft 8 has a solid cylindrical structure, a roller sleeve 9 is sleeved on the lower intermediate shaft 8 at a spindle position corresponding to each spindle, and the roller sleeve 9 is integrally fixedly connected with the lower intermediate shaft 8. The rear upper rubber roller 3, the middle upper rubber roller 5 and the front upper rubber roller 7 have the same structure. The rear upper rubber roller 3, the middle upper rubber roller 5 and the front upper rubber roller 7 at the spindle positions corresponding to each spindle are arranged independently. Each of the rear upper rubber roller 3, the middle upper rubber roller 5 and the front upper rubber roller 7 includes an upper intermediate shaft 10, the upper intermediate shaft 10 has a solid cylindrical structure, a rubber roller sleeve 11 is sleeved on the upper intermediate shaft 10, the left end and the right end of the rubber roller sleeve 11 are connected to the upper intermediate shaft 10 through a first left bearing 12 and a second right bearing 13 respectively, and the rubber roller sleeve 11 can rotate freely about the upper intermediate shaft 10. The rear upper rubber roller 3, the middle upper rubber roller 5 and the front upper rubber roller 7 at the spindle positions corresponding to each spindle are clasped and connected to a pressing assembly. The right ends of the lower intermediate shafts 8 of the rear lower roller 2, the middle lower roller 4 and the front lower roller 6 extend out of the roller sleeves 9 at the spindle positions corresponding to the rightmost spindles. The right end of the lower intermediate shaft 8 of the front lower roller 6 is driven to rotate by a main motor 23, the right end of the lower intermediate shaft 8 of the middle lower roller 4 is connected to the lower intermediate shaft 8 of the front lower roller 6 through a first gear box 22, and the right end of the lower intermediate shaft 8 of the rear lower roller 2 is connected to the lower intermediate shaft 8 of the middle lower roller 4 through a second gear box 21. The main motor 23 directly drives the lower intermediate shaft 8 of the front lower roller 6 to rotate, then the lower intermediate shaft 8 of the middle lower roller 4 is driven to rotate through the first gear box 22, and the lower intermediate shaft 8 of the rear lower roller 2 is driven to rotate through the second gear box 21. The rotation speed ratio of the rear lower roller 2 to the middle lower roller 4 is equal to a drawing multiple of a rear drawing zone between the rear roller drawing pair and the middle roller drawing pair, and is determined by a gear ratio of the second gear box 21. The rotation speed ratio of the middle lower roller 4 to the front lower roller 6 is equal to a drawing multiple of a front drawing zone between the middle roller drawing pair and the front roller drawing pair, and is determined by a gear ratio of the first gear box 22. The drawing multiple of the rear drawing zone is far smaller than the drawing multiple of the front drawing zone. A left magnet 14 and a right magnet 15 are arranged around the outer circumference of the roller sleeve 9 of the middle lower roller 4 surrounding the spindle position corresponding to each spindle, the left magnet 14 and the right magnet 15 are symmetric on the roller sleeve 9 of the middle lower roller 4 and horizontal relative to the surface of the roller sleeve 9 of the middle lower roller 4. An adsorption roller 16 is mounted to the front part of the front upper rubber roller 7 at the spindle position corresponding to each spindle, the adsorption roller 16 includes a first intermediate shaft 17, the first intermediate shaft 17 has a solid cylindrical structure, an adsorption roller sleeve 18 is sleeved on the first intermediate shaft 17, the left end and the right end of the adsorption roller sleeve 18 are connected to the first intermediate shaft 17 through a third left bearing 19 and a fourth right bearing 20 respectively, and the adsorption roller sleeve 18 can rotate freely about the first intermediate shaft 17. The left end and the right end of the first intermediate shaft 17 are fixedly connected to the left end and the right end of the upper intermediate shaft 10 of the front upper rubber roller 7 through connecting rods respectively, and the adsorption roller sleeve 18 abuts against the rubber roller sleeve 9 of the front upper rubber roller 7. A middle magnet 24 is arranged on the outer circumference of the adsorption roller sleeve 18 of the adsorption roller 16 surrounding the spindle position corresponding to each spindle, and the middle magnet 24 is horizontal relative to the surface of the adsorption roller sleeve 18 of the adsorption roller 16. The left magnet 14, the right magnet 15 and the middle magnet 24 have the same polarity at relative positions of magnetic fibers, and are opposite in polarity to the magnetic fibers contained in the magnetic fiber blended conformal yarns.

When spinning, the pressing assembly is pressed down, so that the roller sleeve 9 of the rear lower roller 2 and the rubber roller sleeve 11 of the rear upper rubber roller 3 press each other tightly, the roller sleeve 9 of the middle lower roller 4 and the rubber roller sleeve 11 of the middle upper rubber roller 5 press each other tightly, and the roller sleeve 9 of the front lower roller 6 and the rubber roller sleeve 11 of the front upper rubber roller 7 press each other tightly. The main motor 23 directly drives the lower intermediate shaft 8 of the front lower roller 6 to rotate, then the rubber roller sleeve 11 of the front upper rubber roller 7 that tightly presses the roller sleeve 9 of the front lower roller 6 is driven to rotate, and the adsorption roller sleeve 18 of the adsorption roller 16 in close contact with the rubber roller sleeve 11 of the front upper rubber roller 7 is driven to rotate. The lower intermediate shaft 8 of the front lower roller 6 rotates to drive the lower intermediate shaft 8 of the middle lower roller 4 to rotate through the first gear box 22, then the rubber roller sleeve 11 of the middle upper rubber roller 5 that tightly presses the roller sleeve 9 of the middle lower roller 4 is driven to rotate, the lower intermediate shaft 8 of the middle lower roller 4 rotates to drive the lower intermediate shaft 8 of the rear lower roller 2 to rotate through the second gear box 21, and the rubber roller sleeve 11 of the rear upper rubber roller 3 that tightly presses the roller sleeve 9 of the rear lower roller 2 is driven to rotate.

Blended roving 1 is fed by being pressed between the roller sleeve 9 of the rear lower roller 2 and the rubber roller sleeve 11 of the rear upper rubber roller 3. The fed blended roving 1 includes at least two types of short fibers, including magnetic fibers and non-magnetic fibers. The fed blended roving 1 is pressed tightly between the roller sleeve 9 of the rear lower roller 2 and the rubber roller sleeve 11 of the rear upper rubber roller 3 and driven to continuously move forward by synchronous rotation of the roller sleeve 9 of the rear lower roller 2 and the rubber roller sleeve 11 of the rear upper rubber roller 3. At this time, the fibers in the blended roving 1 produce a first frictional force field for controlling the fibers under the frictional force of the roller sleeve 9 of the rear lower roller 2 and the rubber roller sleeve 11 of the rear upper rubber roller 3, so that the fibers in the blended roving 1 move forward at a speed consistent with the linear speed of the roller sleeve 9 of the rear lower roller 2 under the control of the first frictional force field. When the blended roving 1 moves to be tightly pressed between the roller sleeve 9 of the middle lower roller 4 and the rubber roller sleeve 11 of the middle upper rubber roller 5, the blended roving 1 is driven to continuously move forward by synchronous rotation of the roller sleeve 9 of the middle lower roller 4 and the rubber roller sleeve 11 of the middle upper rubber roller 5. At this time, the fibers generate a second frictional force field for controlling the fibers under the frictional force of the roller sleeve 9 of the middle lower roller 4 and the rubber roller sleeve 11 of the middle upper rubber roller 5, so that the fibers move forward at a speed consistent with the linear speed of the roller sleeve 9 of the middle lower roller 4 under the control of the second frictional force field. When the fibers in the roving are out of the control range of the first frictional force field and within the control range of the second frictional force field, the moving speed of the fibers is changed from being consistent with the linear speed of the roller sleeve 9 of the rear lower roller 2 to being consistent with the linear speed of the roller sleeve 9 of the middle lower roller 4. Since the rotation speed of the middle lower roller 4 is greater than that of the rear lower roller 2, the fibers move fast, that is, the slow movement of the fibers at a speed consistent with the linear speed of the roller sleeve 9 of the rear lower roller 2 is changed into fast movement at a speed consistent with the linear speed of the roller sleeve 9 of the middle lower roller 4. In this process, on the one hand, the intertwined fast fibers and slow fibers in the blended roving 1 are slipped, so that the linear density of the fed blended roving 1 is reduced in a ratio equal to the drawing multiple of the rear drawing zone, to achieve a weak drawing process of the fed blended roving 1; and on the other hand, the fibers rotate axially in slow slippage of the fast fibers and the slow fibers due to the small drawing multiple of the rear drawing zone, and the direction of rotation is reversed from the twist direction of the blended roving 1, so that the twist in the fed blended roving 1 is greatly reduced, and a strong untwisting process of the fed roving is achieved. The fed blended roving 1 forms first strands of fibers with a weak twist under the drawing and untwisting action in the rear drawing zone. When the first strands of fibers discharged by pressing of the roller sleeve 9 of the middle lower roller 4 and the rubber roller sleeve 11 of the middle upper rubber roller 5 are discharged in front of the roller sleeve 9 of the middle lower roller 4, the magnetic fibers are further dispersed in the first strands under the attraction of the left magnet 14 and the right magnet 15, and drive other fibers to move during attracted movement, so that all the fibers in the first strands are further dispersed, the intertwining between the fibers is also reduced during the dispersion, the twist of the first strands is further reduced, and the magnetic fibers are mainly distributed on the left and right sides in the first strands.

When the blended roving 1 moves to be tightly pressed between the roller sleeve 9 of the front lower roller 6 and the rubber roller sleeve 11 of the front upper rubber roller 7, the blended roving 1 is driven to continuously move forward by synchronous rotation of the roller sleeve 9 of the front lower roller 6 and the rubber roller sleeve 11 of the front upper rubber roller 7. At this time, the fibers produce a third frictional force field for controlling the fibers under the frictional force of the roller sleeve 9 of the front lower roller 6 and the rubber roller sleeve 11 of the front upper rubber roller 7, so that the fibers move forward at a speed consistent with the linear speed of the roller sleeve 9 of the front lower roller 6 under the control of the third frictional force field. When the fibers in the first strands are out of the control range of the second frictional force field and within the control range of the third frictional force field, the moving speed of the fibers is changed from being consistent with the linear speed of the roller sleeve 9 of the middle lower roller 4 to being consistent with the linear speed of the roller sleeve 9 of the front lower roller 6. Since the rotation speed of the front lower roller 6 is greater than that of the middle lower roller 4, the fibers move fast. That is, the slow movement of the fibers at a speed consistent with the linear speed of the roller sleeve 9 of the middle lower roller 4 is changed into fast movement at a speed consistent with the linear speed of the roller sleeve 9 of the front lower roller 6. In this process, the intertwined fast fibers and slow fibers in the first strands are slipped rapidly due to the large drawing multiple of the front drawing zone, so that the linear density of the first strands becomes small in a ratio equal to the drawing multiple of the front drawing zone, to achieve a strong drawing process of the first strands in the front drawing zone. At the same time, the fibers in the first strands rotate slightly axially during rapid slippage, thereby achieving a weak untwisting process of the first strands in the front drawing zone, and obtaining second strands with a very weak twist. When the second strands of fibers discharged by pressing of the roller sleeve 9 of the front lower roller 6 and the rubber roller sleeve 11 of the front upper rubber roller 7 are discharged in front of the roller sleeve 9 of the front lower roller 6, the magnetic fibers that are relatively dispersed in the second strands and mainly located on the left and right sides of the second strands float under the attraction of the middle magnet 24, so that the magnetic fibers are closely attached to the surface of the adsorption roller sleeve 18 of the adsorption roller 16 and discharged forward with the rotation of the adsorption roller 16. The other fibers are closely attached to the surface of the roller sleeve 9 of the front lower roller 6 and discharged forward with the rotation of the roller sleeve 9. Under the action of the spinning design twist, due to the linear transmission of the twist, the other fibers attached to the surface of the roller sleeve 9 of the front lower roller 6 and kept consistent with the direction of twist transmission are directly twisted by the design twist, so that the fibers except the magnetic fibers in the second strands are closely attached to the roller sleeve 9 of the front lower roller 6, strongly twisted and located at the cores of final yarns. The floating magnetic fibers are inconsistent with the direction of twist transmission, so that the magnetic fibers are indirectly twisted by the design twist, where the degree of twisting the magnetic fibers is smaller than that of twisting the other fibers. Since the magnetic fibers are mainly located on the left and right sides of the other fibers, the magnetic fibers in the second strands are twisted close to the upper part of the adsorption roller 16 and located on the outer parts of the final yarns. The magnetic fibers are intertwined into short fiber aggregates under the weak twist to completely cover and coat the cores to obtain final magnetic fiber blended conformal yarns, thereby forming overall yarn structures that are tight inside but loose outside, and achieving high conformal property and excellent health-care effect of the blended yarns.

What is claimed is:

1. A production method for magnetic fiber blended conformal yarns, comprising the following steps:

(1) feeding blended roving by pressing at the rear roller drawing pair, wherein the fed blended roving comprises at least two types of short fibers, comprising at least one type of magnetic fiber and at least one type of non-magnetic fiber; untwisting and drawing the blended roving at the rear drawing zone between the rear roller drawing pair and the middle roller drawing pair, and thoroughly dispersing the magnetic fibers in first strands obtained between the left magnet and the right magnet; and (2) strongly twisting and thoroughly drawing the first strands at the front drawing zone between the middle roller drawing pair and the front roller drawing pair, and upwardly adsorbing the magnetic fibers in second strands obtained through the middle magnet on the adsorption roller; and causing other fibers except the magnetic fibers in the second strands to form cores of final yarns, and the magnetic fibers in the second strands to form outer parts of the final yarns, thus forming overall yarn structures that are tight inside but loose outside.

2. The production method for magnetic fiber blended conformal yarns according to claim 1, wherein in step (1), when spinning, the pressing assembly is pressed down, so that the rear lower roller and the rear upper rubber roller, the middle lower roller and the middle upper rubber roller, and the front lower roller and the front upper rubber roller press each other tightly, the motor directly drives the front lower roller to rotate, the front lower roller drives the middle lower roller to rotate, and the middle lower roller drives the front lower roller to rotate; and the rear lower roller, the middle lower roller and the front lower roller respectively drive the rear upper rubber roller, the middle upper rubber roller, the front upper rubber roller and the adsorption roller to rotate;

the rotation speed of the rear roller drawing pair is smaller than that of the middle roller drawing pair; the fed blended roving is advanced between the rear roller drawing pair and the middle roller drawing pair, so that the linear density of the fed blended roving becomes small in a ratio equal to the drawing multiple of the rear drawing zone, and a weak drawing process and a strong untwisting process of the fed roving are achieved; the fed blended roving form first strands of fibers with a weak twist under the drawing and untwisting action in the rear drawing zone; when being discharged in front of the middle roller drawing pair, the magnetic fibers are further dispersed in the first strands under the attraction of the left magnet and the right magnet, and drive other fibers to move during attracted movement, so that all the fibers in the first strands are further dispersed, the twist of the first strands is further reduced, and the magnetic fibers are mainly distributed on left and right sides in the first strands.

3. The production method for magnetic fiber blended conformal yarns according to claim 1, wherein in step (2), the rotation speed of the middle roller drawing pair is smaller than that of the front roller drawing pair; the first strands are advanced between the middle roller drawing pair and the front roller drawing pair, so that the linear density of the first strands becomes small in a ratio equal to the drawing multiple of the front drawing zone, a strong drawing process and a weak untwisting process of the first strands in the front drawing zone are achieved, and second strands with a very weak twist are obtained; the magnetic fibers on the left and right sides of the second strands discharged by the front roller drawing pair float under the attraction of the middle magnet, so that the magnetic fibers are closely attached to the surface of the adsorption roller and discharged forward with the rotation of the adsorption roller, the other fibers are closely attached to surface of the front roller and discharged forward, and the other fibers except the magnetic fibers in the second strands are strongly twisted close to the front roller and located at the cores of final yarns; the fibers are inconsistent with the direction of twist transmission due to the floating of the magnetic fibers, so that the magnetic fibers are indirectly twisted by the design twist, wherein the degree of twisting the magnetic fibers is smaller than that of twisting the other fibers; since the magnetic fibers are mainly located on left and right sides of the other fibers, the magnetic fibers in the second strands are twisted close to upper part of the adsorption roller and located at outer parts of the final yarns, and the magnetic fibers are intertwined into short fiber aggregates under the weak twist to completely cover and coat the cores to obtain final magnetic fiber blended conformal yarns.

* * * * *